US008820230B2

(12) United States Patent
Inoue et al.

(10) Patent No.: US 8,820,230 B2
(45) Date of Patent: Sep. 2, 2014

(54) METHOD FOR PRINTING ON SPHERICAL OBJECT AND PAD TO BE USED THEREFOR

(75) Inventors: Nobuya Inoue, Chichibu (JP); Takashi Ohira, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 13/411,754

(22) Filed: Mar. 5, 2012

(65) Prior Publication Data

US 2012/0222574 A1 Sep. 6, 2012

Related U.S. Application Data

(62) Division of application No. 12/034,688, filed on Feb. 21, 2008, now Pat. No. 8,151,704.

(51) Int. Cl.

| | |
|---|---|
| ***B41F 17/30*** | (2006.01) |
| ***B41M 1/40*** | (2006.01) |
| ***B41F 17/00*** | (2006.01) |
| ***A63B 45/02*** | (2006.01) |

(52) U.S. Cl.

CPC ..... *B41F 17/001* (2013.01); *B41M 1/40* (2013.01); *Y10S 101/40* (2013.01); *A63B 2243/0029* (2013.01); *A63B 2243/0083* (2013.01); *A63B 45/02* (2013.01); *B41F 17/30* (2013.01)

USPC ..... 101/41; 101/379; 101/483; 101/163; 101/170; 101/DIG. 40

(58) Field of Classification Search

None

See application file for complete search history.

(56) References Cited

U.S. PATENT DOCUMENTS

| | | | | |
|---|---|---|---|---|
| 2,748,696 | A | 6/1956 | Murray | |
| 4,253,252 | A | 3/1981 | Eisenberg | |
| 6,244,172 | B1 * | 6/2001 | Holmberg et al. | 101/41 |
| 6,604,458 | B1 | 8/2003 | De Volder | |
| 7,644,657 | B1 | 1/2010 | Clark et al. | |
| 2002/0100378 | A1 | 8/2002 | Dupuis | |

FOREIGN PATENT DOCUMENTS

| | | |
|---|---|---|
| JP | 1-119270 A | 5/1989 |
| JP | 7-18841 U | 4/1995 |

OTHER PUBLICATIONS

Japanese Office Action issued in Japanese Application No. 2009-039187 dated Jan. 7, 2013.

* cited by examiner

*Primary Examiner* — Joshua D Zimmerman

(74) *Attorney, Agent, or Firm* — Sughrue Mion, PLLC

(57) ABSTRACT

A method and apparatus for printing is provided. The method includes preparing a hollow printing pad having a transfer surface, the printing pad being configured so that when the transfer surface is pushed, the gas in the hollow part is released to the outside of the printing pad; transferring ink or paint in recesses formed on the surface of a printing plate to the transfer surface of the printing pad by applying the ink or paint onto the surface of the printing plate and by pressing the transfer surface of the printing pad against the surface of the printing plate; and transferring the ink or paint to the object to be printed by pressing the transfer surface of the printing pad against the object to be printed until at least the hemispherical portion of the object to be printed is wrapped by the transfer surface of the printing pad.

6 Claims, 4 Drawing Sheets

METHOD FOR PRINTING ON SPHERICAL OBJECT AND PAD TO BE USED THEREFOR

CROSS-REFERENCE TO RELATED APPLICATIONS

This application is a divisional of U.S. application Ser. No. 12/034,688, filed Feb. 21, 2008, the entire content of which is incorporated herein by reference.

BACKGROUND OF THE INVENTION

The present invention relates to a method for printing on a spherical object to be printed such as a golf ball. Also, the present invention relates to a pad used for such a printing method, and a golf ball on which printing is performed by such a printing method.

As a device for printing images such as letters and pictures, a pad printing system has been used. The pad printing system has an elastic pad and operates as described below. On the surface of a printing plate, recesses are formed according to an image to be printed. Ink is applied onto the surface of the printing plate and fills the recesses. A pad is pressed against the surface of the printing plate, thereby transferring the ink in the recesses to the pad. Further, the pad is pressed against an object to be printed, by which the image is printed on the object to be printed. Since the pad has elasticity, the pad printing system can print images on not only a flat surface but also a curved surface such as a golf ball surface as described, for example, Japanese Patent Application Publication No. 2004-243033.

For the conventional pad printing system, there arises a problem as described below when an attempt is made to print the whole surface of a spherical object to be printed. In the case where the whole surface of the spherical object to be printed is printed, usually, the spherical object to be printed is replaced with a polyhedron at least a tetrahedron, and the pad is pressed against the faces a number of times according the number of faces. Therefore, in order to print the whole surface of a sphere, the pad must be pressed against the sphere many times at least four times, so that the productivity is low.

Also, in the case where a spherical surface is pad-printed, the photoengraving work is troublesome. For example, in the case where the spherical surface is printed using a pad having a substantially conical shape, the image formed on a plane-like printing plate is printed on the spherical surface in such a manner that the image distorts so as to extend long from the center toward the outside of the pad. Therefore, when the image to be printed on the spherical surface is formed on the plane-like printing plate, photoengraving must be performed by correcting the length of image and the depth of ink groove considering such distortion of image.

As the number of faces to be printed increases, the number of form plates to be manufactured increases. Therefore, the increase in printed face further imposes a burden on the photoengraving work. Also, it is necessary to transfer the image on each printing plate to the spherical surface of the object to be printed while aligning the mutual positions. Therefore, the increase in printed face also imposes a burden on the transferring work involving positioning work.

SUMMARY OF THE INVENTION

The present invention has been made to solve the above problems, and accordingly an object of the present invention is provide a printing method in which at least approximately hemispherical portion of a spherical object to be printed can be printed by pressing a pad against the portion one time, and which can prevent an image printed on the spherical object to be printed from being elongated or distorted, and a printing pad used for this printing method.

One aspect of the present invention is a method for printing on a spherical object to be printed. The method in accordance with the present invention comprises the steps of preparing a hollow printing pad having a transfer surface, the printing pad being configured so that when the transfer surface is pushed, the gas in the hollow part is released to the outside of the printing pad; transferring ink or paint in recesses formed on the surface of a printing plate to the transfer surface of the printing pad by applying the ink or paint onto the surface of the printing plate and by pressing the transfer surface of the printing pad against the surface of the printing plate; and transferring the ink or paint, which has been transferred to the transfer surface of the printing pad, to the object to be printed by pressing the transfer surface of the printing pad, to which the ink or paint has been transferred, against the object to be printed until at least the hemispherical portion of the object to be printed is wrapped by the transfer surface of the printing pad.

The volume of the hollow part of the printing pad may be larger than the volume of the object to be printed. The printing pad may have an inner surface defining the hollow part. The maximum distance between two points of the inner surface in a plane perpendicular to the direction in which the printing pad is pressed against the object to be printed may be larger than the diameter of the object to be printed. The length of the hollow part of the printing pad in the direction in which the printing pad is pressed against the object to be printed may be larger than the diameter of the object to be printed.

The printing pad may have a columnar side surface adjacent to the transfer surface having a substantially hemispherical shape. The thickness of pad between the side surface and the inner surface may be larger than the thickness of pad between the transfer surface and the inner surface. The hardness of pad on the side surface may be higher than the hardness of pad on the transfer surface. A structure for enhancing the bending stiffness of pad may be arranged between the side surface and the inner surface. A cylindrical structure may be arranged so as to surround the outer periphery of the side surface. At least three notches may be located on the side surface.

The printing method in accordance with the present invention may further comprises the steps of transferring ink or paint in the recesses formed on the surface of the printing plate again to the transfer surface of the printing pad by applying the ink or paint again onto the surface of the printing plate after the hemispherical portion of the object to be printed has been printed and by pressing the transfer surface of the printing pad against the surface of the printing plate; and transferring the ink or paint, which has been transferred to the transfer surface of the printing pad, to the object to be printed by pressing the transfer surface of the printing pad, to which the ink or paint has been transferred, against the remaining hemispherical portion of the object to be printed until the remaining hemispherical portion of the object to be printed is wrapped by the transfer surface of the printing pad.

The object to be printed may be a golf ball, a Park golf ball, a Ground golf ball, a tennis ball, or the like.

Another aspect of the present invention is a golf ball that is printed by the above-described method.

Still another aspect of the present invention is a pad for printing the surface of a golf ball. The pad in accordance with the present invention comprises a substantially hemispherical or substantially conical transfer surface; and an inner surface defining a hollow part of the pad, wherein the pad is configured so that when the transfer surface is pushed, the gas in the hollow part is released to the outside of the printing pad.

DETAILED DESCRIPTION OF THE PREFERRED EMBODIMENTS

Embodiments of the present invention will now be described with reference to the accompanying drawings. The embodiments described below are examples for specifically explaining the present invention, and impose no restriction on the present invention.

Figure 1:
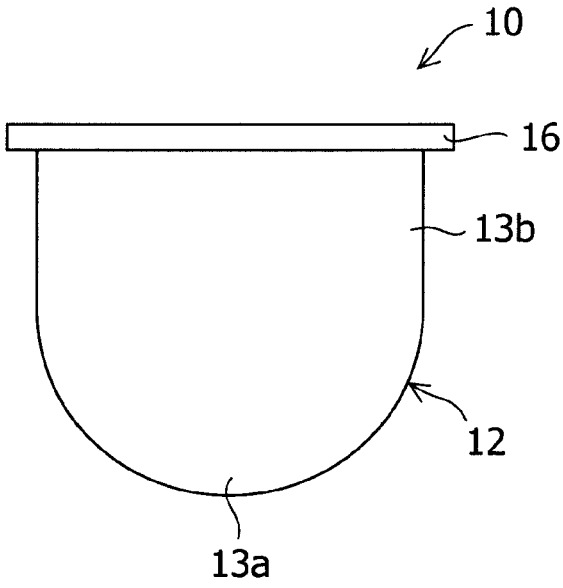
FIG. 1 is a side view schematically showing one embodiment of a printing pad in accordance with the present invention.
Figure 2:
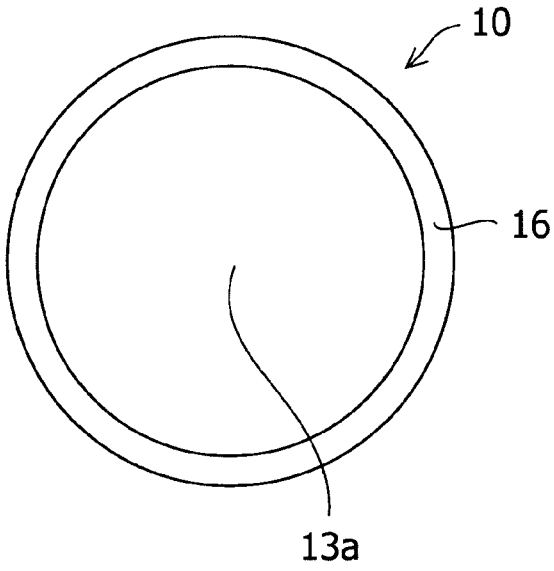
FIG. 2 is a bottom view of the printing pad shown in FIG. 1.
Figure 3:
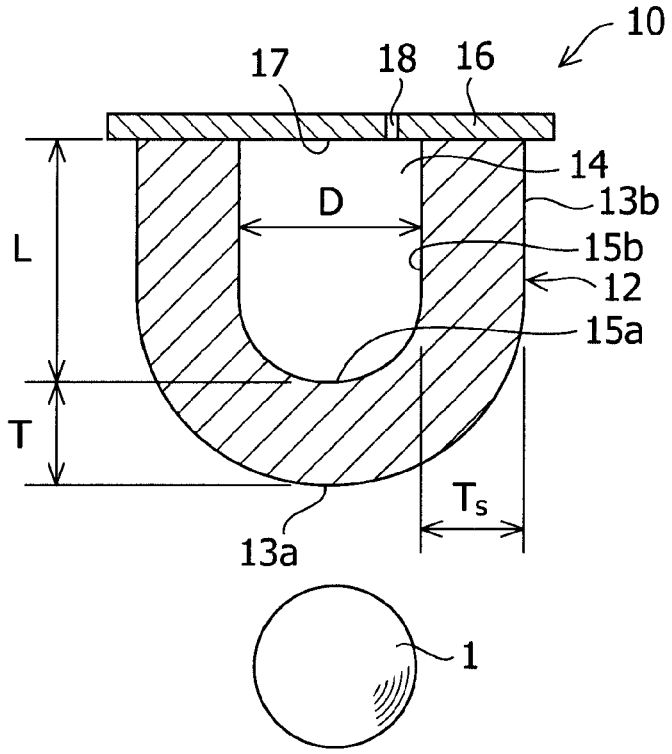
FIG. 3 is a side sectional view of the printing pad shown in FIG. 1.

FIGS. 1 to 3 show a first embodiment of the present invention. As shown in FIGS. 1 and 2, a printing pad 10 of this embodiment includes a pad body 12 and a pad support part 16 for supporting the pad body 12. The pad body 12 has a transfer surface 13*a* at the tip end thereof on the side opposite to the end that joins to the pad support part 16. The transfer surface 13*a* is a part that comes into contact with a spherical object to be printed. In FIGS. 1 and 2, the transfer surface 13*a* having a substantially hemispherical shape is shown, but the transfer surface of the present invention is not limited to this shape. The pad body 12 has a columnar side surface 13*b* adjacent to the transfer surface 13*a*. The side surface 13*b* joins to the pad support part 16.

The printing pad 10 is attached to a pad printing system (not shown) so as to move toward the direction such that the transfer surface 13*a* is the forefront so that the transfer surface 12*a* is pressed against the object to be printed. In this specification, the direction in which the printing pad 10 moves is referred to as the "pressing direction". The pad printing system has been disclosed in the aforementioned Japanese Unexamined Patent Application Publication No. 2004-243033, which is construed as a part of this specification by being cited herein.

As shown in FIG. 3, the pad body 12 is hollow, and has an inner surface defining a hollow part 14. The hollow part 14 is surrounded by an inside tip end surface 15*a* of the pad body 12, an inside side surface 15*b* of the pad body 12, which is adjacent to the inside tip end surface 15*a*, and an inner surface 17*a* of the pad support part 16. The inside tip end surface 15*a* of the pad body 12 has a concave shape. The inside side surface 15*b* of the pad body 12 has an annular cross-sectional shape. Although FIG. 3 shows the pad body 12 having a U-shaped cross section along the pressing direction, the shape of the pad body of the present invention is not limited to this shape.

The inside diameter D of the pad body 12, that is, the maximum distance between the inside side surfaces 13*b* in a plane perpendicular to the pressing direction is preferably larger than the diameter d of a spherical object 1 to be printed. The relationship between the inside diameter D of the pad body 12 and the diameter d of the object 1 to be printed is preferably D≥about 1.2 d, further preferably D≥about 1.4 d, and still further preferably D≥about 1.6 d. Also, if the inside diameter D of the pad body 12 is too large, the force with which the transfer surface 13*a* pushes the spherical object 1 to be printed weakens remarkably in the direction perpendicular to the pressing direction. Therefore, the relationship between the inside diameter D and the diameter d is preferably D≤about 2.5 d, further preferably D≤about 2.3 d, and still further preferably D≤about 2.2 d.

The length L in the pressing direction of the hollow part 14, that is, the distance between the inside tip end surface 15*a* of the pad body 12 and the inner surface 17*a* of the pad support part 16 is preferably larger than the diameter d of the spherical object 1 to be printed. The relationship between the length L in the pressing direction of the hollow part 14 and the diameter d of the object 1 to be printed is preferably L≥about 1.2 d, further preferably L≥about 1.4 d, and still further preferably L≥about 1.5 d. Also, if the length L in the pressing direction of the hollow part 14 is larger than necessary, the printing pad becomes long merely wastefully. Therefore, the relationship between the length L and the diameter d is preferably L≤about 2.0 d, further preferably L≤about 1.9 d, and still further preferably L≤about 1.8 d.

The volume V of the hollow part 14 is preferably larger than the volume v of the spherical object 1 to be printed. Thereby, the pad body 12 can surely be deformed so that the contact surface 13*a* of the pad body 12 wrap at least a hemispherical surface of the spherical object 1 to be printed. The relationship between the volume V of the hollow part 14 and the volume v of the object 1 to be printed is preferably V≥about 1.5 v, further preferably V≥about 2.3 v. Also, if the volume V of the hollow part 14 is too large, the pad body 12 becomes large unnecessarily, so that the whole of the system becomes large, and also the pressing pressure applied to the sphere side surface at the time when the pad body wraps the object 1 to be printed weakens. Therefore, the relationship between the volume V and the volume v is preferably V≤about 7.5 v, further preferably V≤about 5.0 v.

The thickness $T_s$ of the pad body 12 between the outside side surface 13*b* and the inside side surface 15*b* is preferably larger than the thickness $T_p$ of the pad body 12 between the transfer surface 13*a* and the inside tip end surface 15*a*. Thereby, the transfer surface 13*a* of the pad body 12 can surely be brought into contact with a wide area of the hemispherical surface of the spherical object 1 to be printed with a strong force. The relationship between the thickness $T_s$ of the side surface of the pad body 12 and the thickness $T_p$ on the transfer surface 13*a* is preferably $T_s$≥about 1.2 $T_p$. Also, if the thickness $T_s$ of the side surface is too large, the pad body 12 becomes large unnecessarily, so that the whole of the system becomes large, and also the side surface becomes less liable to be deformed. As a result, the transfer surface elongates, so that the printed image distorts easily. Therefore, the relationship between the thickness $T_s$ and the thickness $T_p$ is preferably $T_s$≤about 2.5 $T_p$.

The thickness $T_p$ of the pad body 12 on the transfer surface 13*a* is preferably smaller than the diameter d of the spherical object 1 to be printed. The relationship between the thickness $T_p$ of the pad body 12 on the transfer surface 13*a* and the diameter d of the spherical object 1 to be printed is preferably $T_p \geq$about 0.1 d, further preferably $T_p \geq$about 0.3 d. As the upper limit of the thickness $T_p$ on the transfer surface 13*a*, the relationship of $T_p \leq$about 0.6 d is preferable, and the relationship of $T_p \leq$about 0.8 d is further preferable.

As the material for the pad body 12, an elastic material is preferably used. The elastic material is not subject to any special restriction if it has elasticity such that when the pad body 12 is pressed against the rigid spherical object 1 to be printed such as a golf ball, the elastic material is deformed so as to wrap the spherical object 1 and, when the force applied to the pad body 12 is removed, the elastic material returns to its original shape. A specific example of such an elastic material is silicone rubber. As the silicone rubber capable of being used as the pad body 12, KE1241 and KE1243 manufactured by Shin-Etsu Chemical Co., Ltd. and DY35 109 manufactured by Dow Corning Toray Co., Ltd. are commercially available.

The hardness of the outside side surface 13*b* of the pad body 12 is preferably higher than the hardness of the transfer surface 13*a* of the pad body 12. Thereby, as in the above-described case where the transfer surface and the outside side surface of the pad body 12 have a different thickness, the transfer surface 13*a* of the pad body 12 can surely be brought into contact with a wide area of the hemispherical surface of the spherical object 1 to be printed with a strong force. The difference in hardness (conforming to Standard of Society of Rubber Industry, Japan, SRISO0101, measured by using a durometer (rubber-plastic hardness meter) GS-701N manufactured by Teclock Corporation) between the transfer surface 13*a* and the outside side surface 13*b* of the pad body 12 is preferably about 5 or higher, further preferably about 10 or higher. Also, a too large difference in hardness makes the side surface less prone to be deformed. Therefore, the difference in hardness is preferably about 40 or lower, further preferably about 30 or lower. By adding a softening agent to the elastic material, the hardness of the transfer surface 13*a* can be adjusted. As the usable softening agent, the RTV thinner manufactured by Shin-Etsu Chemical Co., Ltd. is commercially available.

The hardness (measured by using the aforementioned GS-701N) of the transfer surface 13*a* of the pad body 12 is preferably about 25 or lower, further preferably about 20 or lower. The hardness (measured by using the aforementioned GS-701N) of the outside side surface 13*b* of the pad body 12 is preferably about 30 or higher, further preferably about 35 or higher.

As the material for the pad support part 16, a rigid material is preferably used. The rigid material is not subject to any special restriction if it has stiffness such that when the pad body 12 is pressed against the object 1 to be printed, the rigid material can sufficiently support the pad body 12. A specific example of such a rigid material is a metallic plate or a veneer (plywood). The pad support part 16 is provided with a hole 18 for causing the hollow part 14 to communicate with the outside of the printing pad 10 or the outside air to allow a fluid to flow through.

Next, a method for printing on the surface of the spherical object 1 to be printed by using the printing pad 10 configured as described above is explained. On a printing plate (not shown), recesses are formed according to an image to be printed on the surface of the spherical object 1 to be printed. The printing plate is preferably of a plane shape. First, ink is applied onto the printing plate. After the recesses have been filled with the ink, the transfer surface 13*a* of the printing pad 10 is pressed against the printing plate to transfer the ink in the recesses of the printing plate to the transfer surface 13*a* of the printing pad 10.

Figure 4:
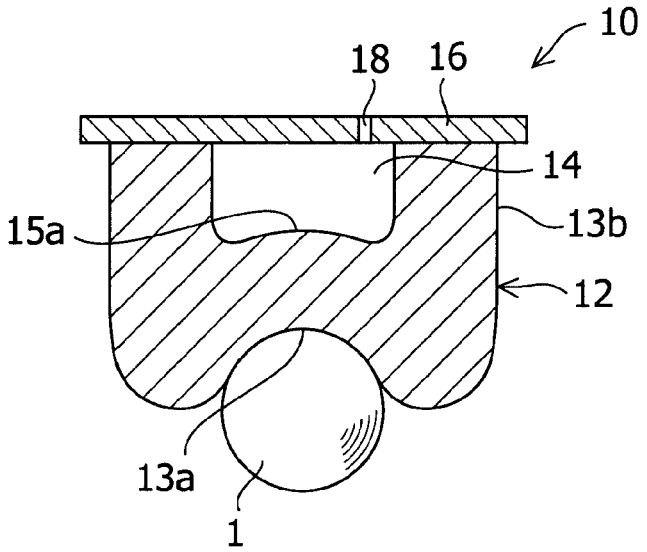
FIG. 4 is a side sectional view schematically showing a method for printing a golf ball by using the printing pad shown in FIG. 1.

Then, the transfer surface 13*a* of the printing pad 10, to which the ink has been transferred, is pressed against the spherical object 1 to be printed. When the transfer surface 13 of the printing pad 10 is pushed, as shown in FIG. 4, the inside tip end surface 15*a* of the pad body 12 is pushed in the direction of the pad support part 16. The air in the hollow part 14 that is present between the pushed inside tip end surface 15*a* and the pad support part 16 is released to the outside of the printing pad 10 through the hole 18 provided in the pad support part 16. Thereby, the transfer surface 13*a* of the printing pad 10 can be deformed enough to wrap at least a hemispherical portion of the spherical object 1 to be printed.

Also, since the air in the hollow part 14 is released, even if the whole of the transfer surface 13*a* is deformed greatly, the difference in deformation ratio of pad between the central part and the peripheral part of the transfer surface 13*a* can be decreased. Therefore, the image transferred from the transfer surface 13*a* of the printing pad 10 to the hemispherical surface of the object 1 to be printed can be restrained from being elongated or distorted locally in the peripheral part of the transfer surface 13*a*.

Thus, by pressing the transfer surface 13*a* of the printing pad 10 against the spherical object 1 to be printed, the ink transferred to the transfer surface 13*a* can be transferred to at least the hemispherical surface of the object 1 to be printed. The ink can be transferred to 55% or more, preferably 60% or more, of the whole surface of the spherical object 1 to be printed while local elongation and distortion of the image are restrained. Such a wide area can be printed by a single pad printing operation, so that the printing productivity is improved greatly.

After ink transferring, the printing pad 10 is separated from the spherical object 1 to be printed, by which the transfer surface 13*a* of the printing pad 10 is returned to its original substantially hemispherical shape. To return the transfer surface 13*a* to its original shape, air can forcedly be sent into the hollow part 14 of the pad body 12 through the hole 18 in the pad support part 16 by using a gas supplying machine (not shown) such as a pump.

In the case where the whole surface of the spherical object 1 to be printed is printed, after the above-mentioned first pad printing operation has been performed, ink is applied onto the same or a different printing plate (not shown), and the transfer surface 13*a* of the printing pad 10 is pressed again against this printing plate to transfer the ink in the recesses of the printing plate to the transfer surface 13*a*. Then, the transfer surface 13*a* of the printing pad 10 is pressed against the remaining hemispherical portion of the object 1 to be printed until the remaining hemispherical portion of the object 1 to be printed is wrapped by the transfer surface 13*a* of the printing pad 10. Thereby, the ink having been transferred to the transfer surface 13*a* is transferred to the remaining hemispherical portion of the object 1 to be printed, by which the printing operation of the whole surface of the spherical object 1 to be printed is finished.

In order to print the image on the hemispherical surface of the spherical object 1 to be printed, the area S of a circular image part formed on the plane-shaped printing plate according to the printed image and the surface area s of the hemisphere of the spherical object 1 to be printed preferably show a relationship described below. As the upper limit, the relationship of $S \geq 0.85s$ is preferable, and as the lower limit, the relationship of $S \leq 0.95s$ is preferable. By making the area S of the image on the printing plate in the above-described range, the distortion of image transferred to the hemispherical surface of the spherical object to be printed by the printing pad in accordance with the present invention can be restrained.

Figure 5:
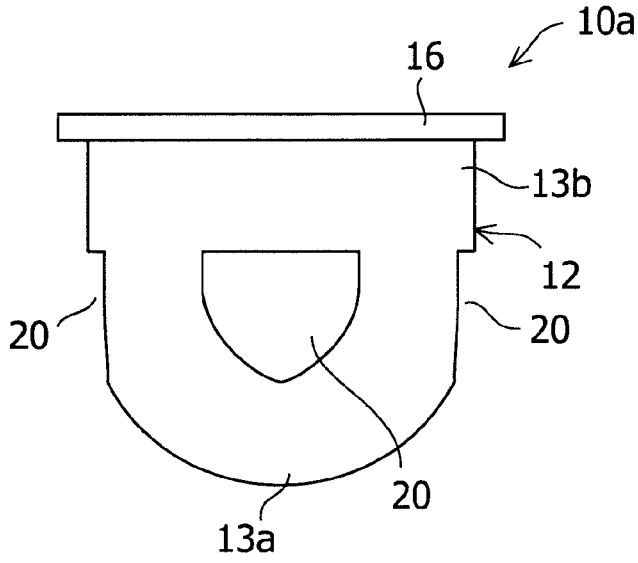
FIG. 5 is a side view schematically showing another embodiment of a printing pad in accordance with the present invention.
Figure 6:
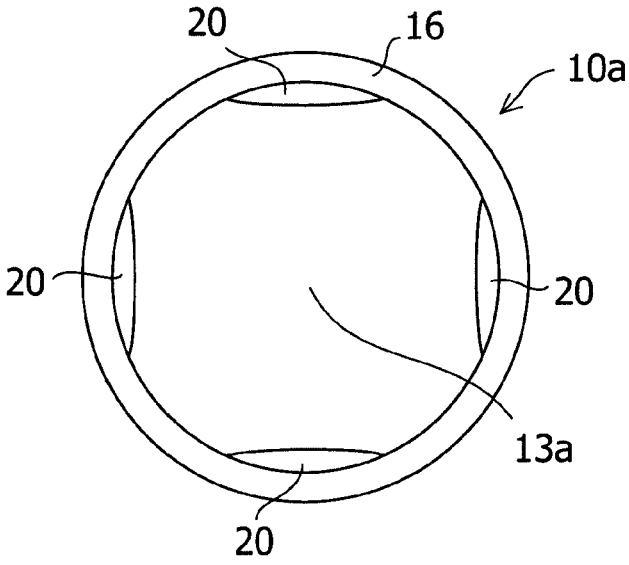
FIG. 6 is a bottom view of the printing pad shown in FIG. 5.

FIGS. 5 and 6 show a second embodiment of the present invention. In these figures, the same reference numerals are applied to elements that are the same as those in the first embodiment. As shown in FIGS. 5 and 6, a printing pad 10*a* of this embodiment is provided with notches 20 penetrating the pad body 12 in parts of the side surface 13*b* and/or parts of the transfer surface 13*a* of the pad body 12. In the case where the notches 20 are provided on the transfer surface 13*a*, the notches 20 are provided in portions having no image to be printed on the object 1 to be printed of the transfer surface 13*a*.

By providing the notches 20 in parts of the side surface 13*b* and/or parts of the transfer surface 13*a* of the pad body 12, wrinkles can be prevented from being formed on the pad body 12 when the printing pad 10*a* is pressed against the object 1 to be printed to deform the transfer surface 13*a* of the pad body 12. Also, when the transfer surface 13*a* of the printing pad 10*a* is pushed, the air in the hollow part 14 of the pad body 12 is released to the outside through the notches 20. In this embodiment, therefore, a hole for releasing air need not be provided in the pad support part 16.

The pad body 12 is preferably provided with three or more notches 20. Also, the plurality of notches 20 are preferably arranged symmetrically with the transfer surface 13*a* being the center.

Figure 7:
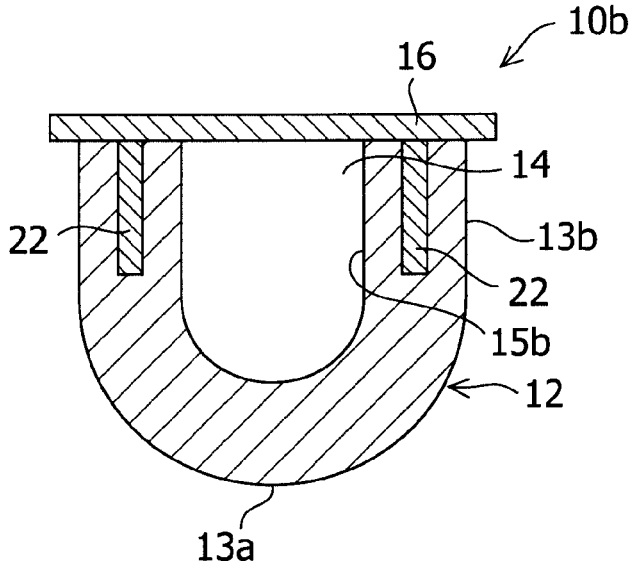
FIG. 7 is a side sectional view schematically showing still another embodiment of a printing pad in accordance with the present invention.

FIG. 7 shows a third embodiment of the present invention. In this figure, the same reference numerals are applied to elements that are the same as those in the first embodiment. As shown in FIG. 7, a printing pad 10*b* of this embodiment has a structure 22 embedded between the outside side surface 13*b* and the inside side surface 15*b* of the pad body 12. By this structure 22, the bending stiffness of the side surface part of the pad body 12 can be enhanced. Thereby, the transfer surface 13*a* of the pad body 12 can surely be brought into contact with a wide area of the hemispherical surface of the spherical object 1 to be printed with a strong force.

The structure may be embedded completely in the pad body 12 as shown in FIG. 7. Alternatively, the structure 22 may be exposed partially so as to form a part of the outside side surface or the inside side surface of the pad body 12. Also, the shape of the structure 22 may be cylindrical as shown in FIG. 3, or may be a plurality of intermittent rod shapes. One end of the structure 22 is preferably joined to the pad support part 16.

The structure 22 is made of a material having a higher bending stiffness than that of the material of the pad body 12. As such a material, for example, glass cloth, carbon cloth, or nonwoven fabric is preferably used because a bending property is left on the side surface of the pad body 12 and from the viewpoint of the workability. The pad body 12 in which the structure 22 is embedded can be molded integrally by arranging the structure in advance in the wall surface part of a mold for the pad body at the time of molding of the pad body, pouring a resin such as silicone into the mold, and curing the resin. In the case where the bonding property of the structure and the resin is low, the bonding property can be improved by impregnating the structure with a primer solution before the resin is poured.

Figure 8:
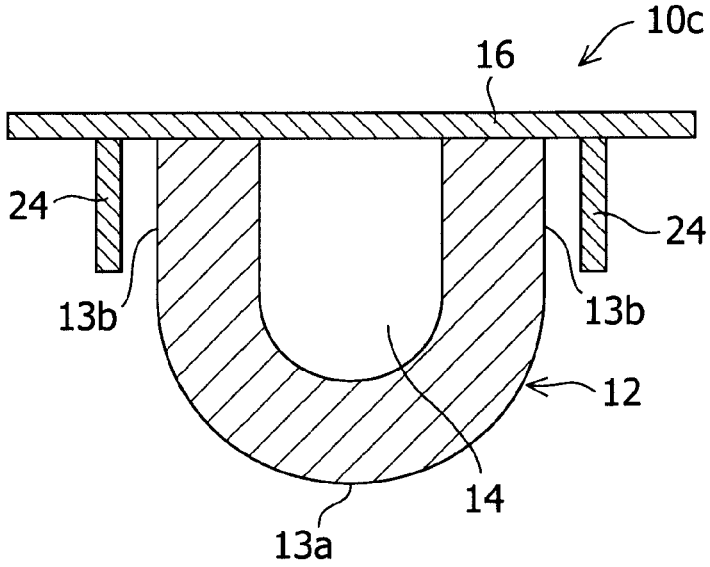
FIG. 8 is a side sectional view schematically showing yet another embodiment of a printing pad in accordance with the present invention.

FIG. 8 shows a fourth embodiment of the present invention. In this figure, the same reference numerals are applied to elements that are the same as those in the first embodiment. As shown in FIG. 8, for a printing pad 10*c* of this embodiment, a cylindrical structure 24 is arranged so as to surround the outer periphery of the outside side surface 13*b* of the pad body 12. One end of the structure 24 is joined to the pad support part 16. By this structure 24 arranged at the outer periphery, the side surface part of the pad body 12 can be restrained from being deformed in the outside direction when the transfer surface 13*a* of the pad body 12 is pushed. Therefore, the transfer surface 13*a* of the pad body 12 can surely be brought into contact with a wide area of the hemispherical surface of the spherical object 1 to be printed with a strong force.

To prevent the deformation of the side surface part of the pad body 12 from being restrained too much, a fixed distance is preferably provided between the outside side surface 13*b* of the pad body 12 and the inside side surface of the structure 24. The relationship between the diameter $D_p$ of the outside side surface 13*b* of the pad body 12 and the diameter $D_s$ of the inside side surface of the structure 24 is preferably $D_s \geq 1.1D_p$, further preferably $D_s \geq 1.2D_p$. Also, if the above-mentioned distance is too large, the deformation of the side surface part of the pad body 12 cannot be restrained. Therefore, the relationship of $D_s \leq 2.0D_p$ is preferable, the relationship of $D_s \leq 1.8D_p$ is further preferable, and the relationship of $D_s \leq 1.6D_p$ is still further preferable.

In all of the first to fourth embodiments, the transfer surface 13*a* of the pad 12 has a substantially hemispherical shape (U-shaped cross section). However, the shape of the transfer surface of the printing pad in accordance with the present invention is not limited to this shape. The transfer surface of the printing pad in accordance with the present invention can have a substantially conical shape (V-shaped cross section). In the case where printing is performed on the surface of a golf ball, the substantially hemispherical or substantially conical transfer surface can prevent air from being entrapped between the transfer surface and the surfaces of many dimples formed on the surface of the golf ball, so that the poor transfer of image to the surface of golf ball can be prevented.

The degree of convex shape of the transfer surface can be expressed by the angle $\alpha$ at the vertex when the transfer surface has a substantially conical shape, and can be expressed by the radius r of the imaginary sphere when the transfer surface has a substantially hemispherical shape. If the angle $\alpha$ or the radius r is made small, the inclination of the transfer surface increases, so that air becomes less liable to be entrapped between the dimples and the transfer surface, but the image at the transfer time is distorted greatly. Therefore, when the transfer surface has a substantially conical shape, the angle $\alpha$ is preferably 90 degrees or larger, further preferably 120 degrees or larger. Also, the angle $\alpha$ is preferably 170 degrees or smaller, further preferably 160 degrees or smaller. When the transfer surface has a substantially hemispherical shape, the radius r is preferably about 1.05 times or more the radius of the columnar pad body, further preferably about 1.3 times or more. Also, the radius r is preferably about 2.5 times or less the radius of the pad body, further preferably about 2 times or less.

As the spherical object to be printed capable of being printed suitably by the printing pad in accordance with the present invention, a sports ball such as a golf ball, a park golf ball, a ground golf ball, and a tennis ball can be cited. However, the spherical object to be printed is not limited to these sports balls.

For the printing pad in accordance with the present invention, a conventional pad printing ink can be used. For example, a resin type ink of vinyl base, acrylic base, urethane base, polyester base, or epoxy base can be used. In the case where a golf ball is printed, an ink capable of withstanding the deformation at the time when the golf ball is hit is preferably used. From the viewpoint of abrasion resistance, a curing type ink is preferable. A two pot curing type urethane base ink is further preferable.

Specifically, the inks disclosed in Japanese Unexamined Patent Application Publication No. 10-234884 and Japanese Unexamined Patent Application Publication No. 2003-253201, which are construed as a part of this specification by being cited herein, are preferably used. The ink in the former publication has high durability. The ink in the latter publication has high wear resistance, impact resistance, and weather resistance. These inks are used by being diluted appropriately using a solvent so that transfer can be accomplished by using the printing pad in accordance with the present invention.

The object to be printed that has been printed by using the printing pad in accordance with the present invention can be dried by using a conventional type drying method such as evaporation drying, two liquid curing, or ultraviolet ray curing. In the case where a golf ball is printed, if the printing is performed under a top coat, the object to be printed is preferably dried by the evaporation drying method from the viewpoint of workability. Also, if the printing is performed over the top coat, the object to be printed is preferably dried by the two liquid curing method or the ultraviolet ray curing method. Of these two methods, the two liquid curing method is preferable from the viewpoint of durability.

According to the printing method in accordance with the present invention, since the whole of the spherical surface can be printed by two pad printing operations, the number of printing plates to be manufactured is only two, so that the photoengraving work is easy. Especially when the image to be printed is a symmetrical picture, one kind of printing plate has only to be prepared, so that the photoengraving work is further easy. Also, since the elongation and distortion produced on the image printed on the hemispherical surface are low, the image correcting work in the photoengraving work is also easy. Further, since the printing area is large, a plurality of images can be printed easily by aligning their positions.

A jig for fixing the spherical object to be printed at a predetermined position can be simplified because the spherical object to be printed has only to be held simply from the direction opposite to the direction in which the printing pad is pressed against the object to be printed since the object to be printed need not be rotated, and therefore a complicated holding method is not specially required.

According to the printing method in accordance with the present invention, in addition to the printing of letters and pictures on the surface of the object to be printed, the object to be printed can be painted uniformly by pad-printing a paint on the whole surface of the object to be printed. For example, the printing method in accordance with the present invention can be applied to the painting of a top coat etc. of a golf ball. The painting using the printing method in accordance with the present invention can anticipate a painting efficiency of 80% and higher. Therefore, a paint loss decreases dramatically, so that the printing cost can be reduced significantly. Also, a large-scale local exhaust system for collecting paint mist, which is needed for spray painting, is not required in the printing method in accordance with the present invention, so that the plant and equipment investment can be decreased. Further, the amount of organic solvent released into the atmosphere and the amount of paint wastes generated are also reduced significantly, so that a load on the environment can be decreased greatly.

What is claimed is:

1. A method for printing on a spherical object to be printed, comprising the steps of:

preparing a hollow printing pad having a transfer surface, the printing pad being configured so that when the transfer surface is pushed, the gas in the hollow part is released to the outside of the printing pad, wherein the printing pad has a columnar side surface adjacent to the transfer surface, and a cylindrical structure is arranged so as to surround the outer periphery of the side surface and to restrain the side surface from being deformed when the transfer surface is pushed, wherein a relationship between a diameter $D_p$ of an outside side surface of the printing pad and a diameter $D_s$ of an inside side surface of the cylindrical structure is $1.05D_p \leq D_s \leq 2.0 D_p$;

transferring ink or paint in recesses formed on the surface of a printing plate to the transfer surface of the printing pad by applying the ink or paint onto the surface of the printing plate and by pressing the transfer surface of the printing pad against the surface of the printing plate; and pressing the transfer surface to transfer the ink or paint, which has been transferred to the transfer surface of the printing pad, to the object to be printed by pressing the transfer surface of the printing pad, to which the ink or paint has been transferred, against the object to be printed until at least the hemispherical portion of the object to be printed is wrapped by the transfer surface of the printing pad, wherein during the pressing the transfer surface a portion of the hollow printing pad contacts the cylindrical structure.

2. The method according to claim 1, wherein the transfer surface of the printing pad has a substantially conical shape, and an angle $\alpha$ at a vertex of the conical shape being within a range of 90 to 170 degrees.

3. The method according to claim 1, wherein the transfer surface of the printing pad has a shape substantially of a portion of a sphere, and a radius r of an imaginary sphere of the shape being within the range of 1.05 to 2.5 times a radius of the columnar side surface of the printing pad.

4. The method according to claim 1, wherein the object to be printed is a golf ball.

5. The method according to claim 1, wherein the object to be printed is a golf ball for Park Golf or Ground Golf.

6. The method according to claim 1, wherein the object to be printed is a tennis ball.

* * * * *